US006176027B1

(12) United States Patent
Blount

(10) Patent No.: US 6,176,027 B1
(45) Date of Patent: Jan. 23, 2001

(54) WATER DISPLAY DEVICE

(76) Inventor: Stanley L. Blount, 6005 Golden Saddle St., Las Vegas, NV (US) 89130

( * ) Notice: Under 35 U.S.C. 154(b), the term of this patent shall be extended for 0 days.

(21) Appl. No.: 09/216,889

(22) Filed: Dec. 18, 1998

(51) Int. Cl.[7] ..... G09F 19/00
(52) U.S. Cl. ..... 40/406; 40/439; 40/477
(58) Field of Search ..... 40/406, 407, 439, 40/477

(56) References Cited

U.S. PATENT DOCUMENTS

| | | | | |
|---|---|---|---|---|
| 2,054,275 | * | 9/1936 | Vellner | 40/406 |
| 2,621,430 | * | 12/1952 | Neville | 40/406 X |
| 2,645,048 | * | 7/1953 | Adams | 40/406 X |
| 3,058,245 | * | 10/1962 | Pieters | 40/406 |
| 3,704,528 | * | 12/1972 | Lewis | 40/406 X |
| 3,973,340 | * | 8/1976 | Khawand | 40/406 |
| 4,111,363 | * | 9/1978 | Kawamura et al. | 40/406 X |
| 4,144,663 | * | 3/1979 | Saenger et al. | 40/406 |
| 4,693,025 | | 9/1987 | Landin . | |
| 4,892,250 | * | 1/1990 | Fuller et al. | 40/406 X |
| 5,075,992 | * | 12/1991 | Kahn | 40/406 X |
| 5,106,660 | | 4/1992 | Vorel . | |
| 5,167,993 | | 12/1992 | Aoyagi . | |
| 5,340,024 | * | 8/1994 | Fuller et al. | 40/406 X |
| 5,363,577 | | 11/1994 | Fuller et al. . | |
| 5,617,657 | * | 4/1997 | Kahn | 40/406 |
| 5,636,669 | | 6/1997 | Price . | |
| 5,683,174 | | 11/1997 | Lena, Jr. . | |

* cited by examiner

*Primary Examiner*—Terry Lee Melius
*Assistant Examiner*—William L. Miller
(74) *Attorney, Agent, or Firm*—Kenneth L Tolar

(57) ABSTRACT

A cascading water system for aesthetically enhancing the appearance of a room includes a water display member having an inlet and an outlet. The display member is mounted within an architectural structure such as a wall, ceiling, doorway or floor. The number and shape of the display members may be varied to create a desired aesthetic effect. The system further includes a fluid reservoir and a conduit that establishes communication between the display member and the reservoir. A pump continuously circulates the water between the reservoir and the display member via the conduit. The conduit includes water jets disposed at the display member inlet so that water is evenly dispersed therethrough. The shape, number and spacing of individual display members may be varied to create a desired effect such as a waterfall.

6 Claims, 9 Drawing Sheets

WATER DISPLAY DEVICE

BACKGROUND OF THE INVENTION

The present invention relates to a device that circulates water through ornamental transparent display members embedded within architectural structures such as walls, floors or ceilings.

DESCRIPTION OF THE PRIOR ART

Water fountains and simulated waterfalls have been long been used as soothing decorative displays for gardens and similar outdoor locations. Conventional water fountains, however, are not practical for indoor use because of the risk that the falling water will damage the surrounding structures. The present invention provides a cascading water system specifically designed for indoor use.

A number of prior patents disclose devices that include transparent containers with fluid therein. However, no devices exist that provide a cascading water system. For example, U.S. Pat. No. 5,106,660 issued to Vorel discloses a decorative wall panel comprising two parallel, vertically disposed spaced panes of glass that are sealed along the bottom and side edges. The panels form a space that is filled with water. At the bottom of the space is a porous tube through which air is dispersed to generate a curtain of bubbles that rises through the water. The curtain of bubbles is illuminated by lights disposed at the edges of the panel.

U.S. Pat. No. 5,363,577 issued to Fuller et al discloses a water display device comprising a plurality of adjacent, parallel tubes filled with a fluid and connected to an air source that injects bubbles into the tubes. The display further comprises a computer that controls the introduction of bubbles to each tube such that the combination of bubbles form a legible design, such as a picture or a word.

U.S. Pat. No. 5,683,174 issued to Lena, Jr. discloses an artistic display that directs light through a panel containing at least two liquids with different colors and specific gravities to project a constantly changing wave pattern onto a display surface. The wave pattern results from the slow oscillation of the panel containing the liquids.

U.S. Pat. No. 5,167,993 issued to Aoyagi discloses a double pane window that obviates the need for blinds or curtains. A pump is used to force opaque or translucent liquids between the panes of glass to reduce or prevent light from passing through the window.

U.S. Pat. No. 5,636,669 issued to Price discloses a system whereby lightweight powdered or colored substances are introduced into hollow transparent panels to selectively change the color of the panels.

The prior art indicates that it is known to pump a fluid into a transparent panel to change the appearance thereof. None of the above devices, however, provide a decorative water display device that can be built into the walls or ceilings of a room to simulate a waterfall.

SUMMARY OF THE INVENTION

The present invention relates to a device for cascading water through an architectural structure such as a wall or ceiling. The device comprises at least one transparent water display member for visibly channeling water along a predetermined path, the path preferably running along the walls or ceiling of a room. Water is pumped to a first end of the display member from a holding tank via PVC piping. The water exits the opposing end of the display member and falls back into the holding tank. The entrance to the holding tank is spaced a predetermined distance from the display member so that the water falling into the tank simulates a waterfall. A pump continuously circulates the water to and from the holding tank to provide a decorative water recirculation system.

It is therefore an object of the present invention to provide a device designed for indoor locations that can safely produce and display cascading water.

It is another object of the present invention to provide an indoor water display device that is incorporated into the walls, ceiling, and/or floor of a building.

It is yet another object of the present invention to provide at least one transparent display member imbedded in the walls and/or ceiling of a room, together with at least one transparent reservoir spaced from the transparent display member and at least one pump for circulating water from the reservoir into the display members to simulate waterfalls and fountains.

Other objects, features and advantages of the present invention will become readily apparent from the following detailed description of the preferred embodiments when considered with the attached drawings and the appended claims.

DESCRIPTION OF THE PREFERRED EMBODIMENTS

Figure 1:
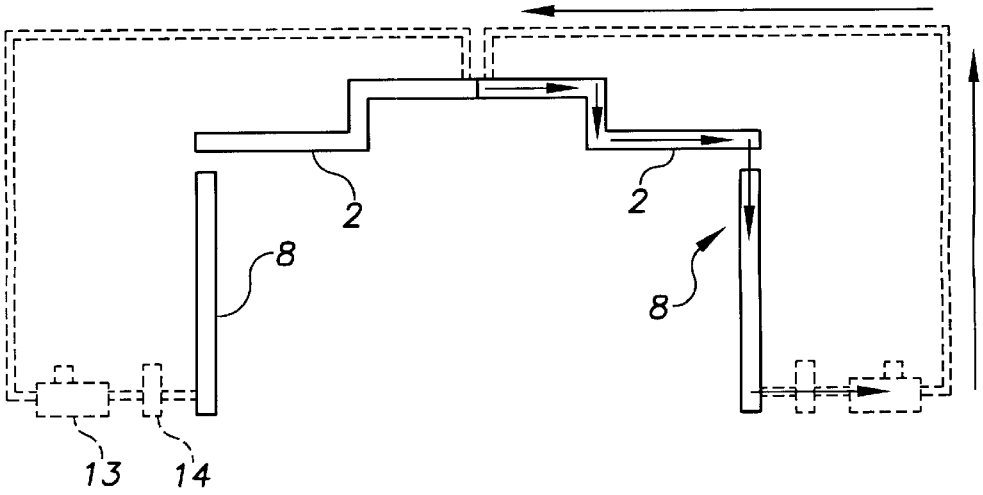
FIG. 1 depicts a front view of a first embodiment according to the present invention formed of a pair of cascading units built into a wall.
Figure 2:
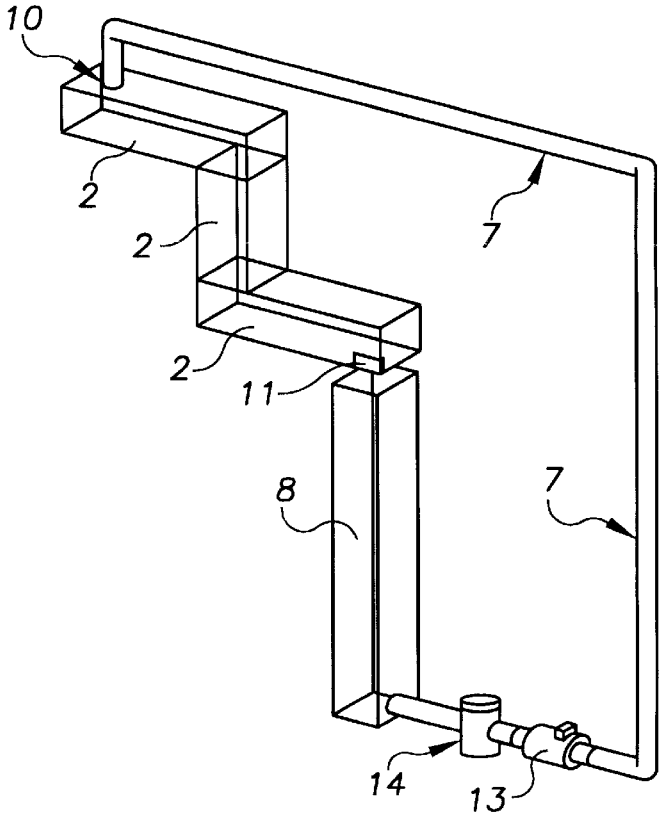
FIG. 2 depicts a perspective view of one of the display units depicted in FIG. 1.

The present invention relates to a water display system for enhancing the aesthetic appearance of a building interior. In general, the device comprises one or more transparent, hollow water display members 2 built into an architectural structure such as a ceiling 3, a wall 4, a floor, a window frame 5, a doorway and similar locations. Each display member has a predetermined shape and includes a water inlet 10 and a water outlet 11. The display members are mounted within the architectural structure so that at least a portion thereof is visible to passersby. A first end of a conduit 7 is coupled with the display member inlet and includes a water jet 9 to project water evenly and outwardly within the display member. The opposing end is coupled with a fluid reservoir 8. The fluid reservoir includes an open top spaced immediately below a display member outlet for receiving water therefrom. A portion of the reservoir is also preferably visible from the exterior of the architectural structure. The display member outlet is suspended immediately above the inlet of a second display member or the reservoir open top whereby the water may be continuously recirculated through one or more display members to achieve a desired aesthetic effect. The conduit further includes a pump 13 for continuously circulating the water between the display members and reservoir. The conduit also includes a filter 14 for removing particulates from the water. In addition, multi colored lighting may be projected towards the display members to further enhance the aesthetic effect of the water circulating therethrough.

Figure 3:
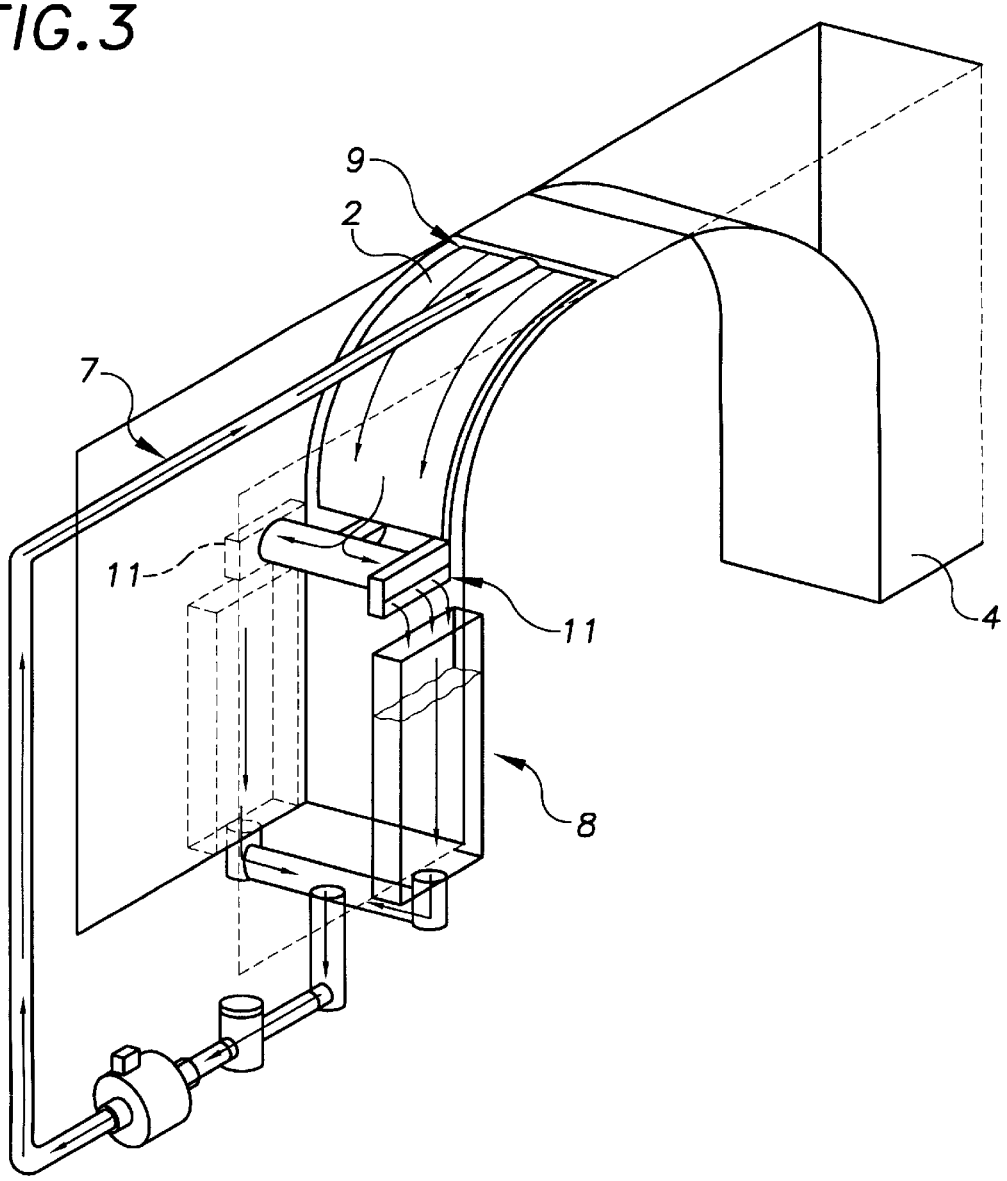
FIG. 3 depicts a perspective view of a second embodiment designed for arched doorway headers.
Figure 4:
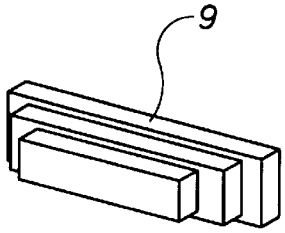
FIG. 4 depicts an isolated perspective view of a water jet according to the present invention.
Figure 5:
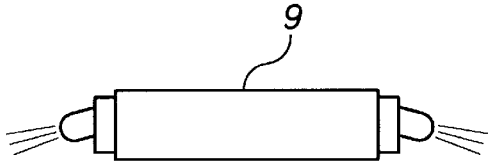
FIG. 5 depicts an isolated front view of a two-sided water jet.

The shape, size, arrangement and number of display members may be varied to suit a particular application or to mount the device within a specific architectural structure. For example, FIG. 1 depicts display members arranged in a stair step fashion which are designed to be built into a wall adjacent a doorway. FIG. 3 depicts a substantially planar, arcuate display member built into an arcuate passageway. A pair of reservoirs may be disposed at each end of the display member, each of which are visibly mounted within a wall adjacent the doorway, and at both sides of the archway.

Figure 7:
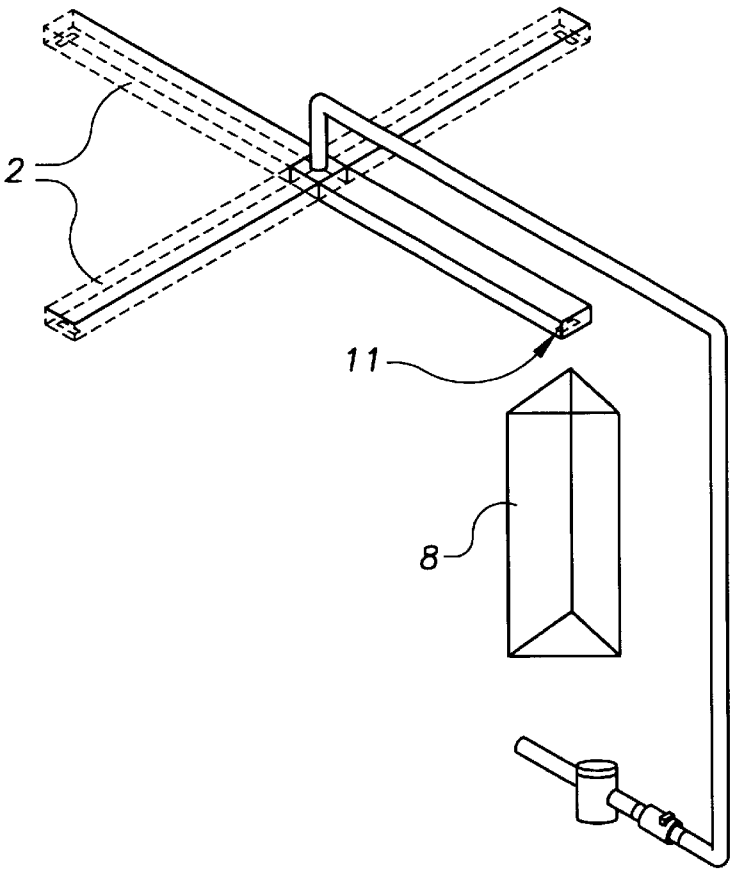
FIG. 7 depicts a partial perspective view of the third embodiment.
Figure 6:
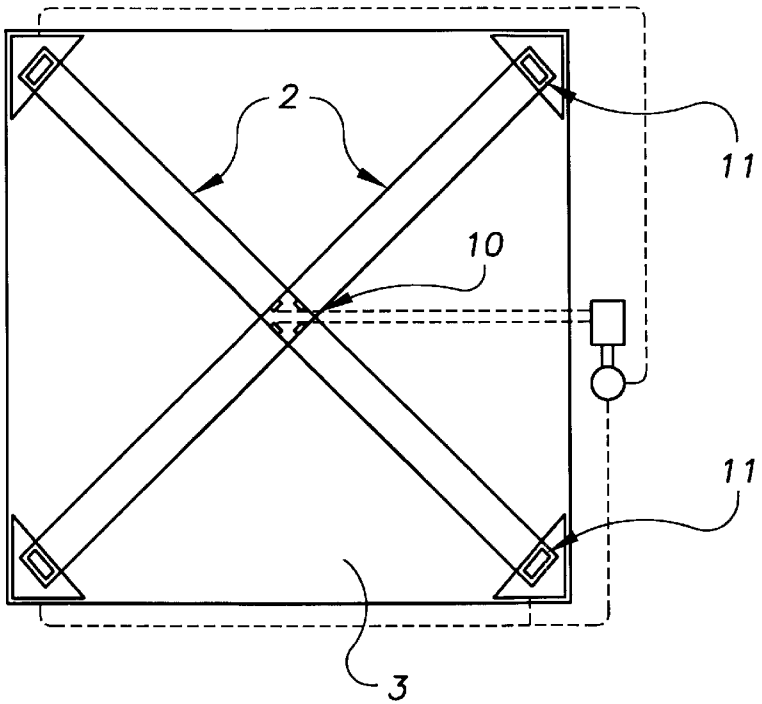
FIG. 6 depicts a bottom view of a third embodiment of the present invention designed to be mounted within a ceiling.

FIGS. 6 and 7 refer to a T-shaped display member visibly mounted within a ceiling. Each end of the display member includes an outlet disposed above and vertically aligned with a reservoir having a triangular cross-sectional configuration. The reservoirs are mounted within each of four corners of a room. The conduit, pump and filter are concealably disposed behind the walls of the room.

Figure 9:
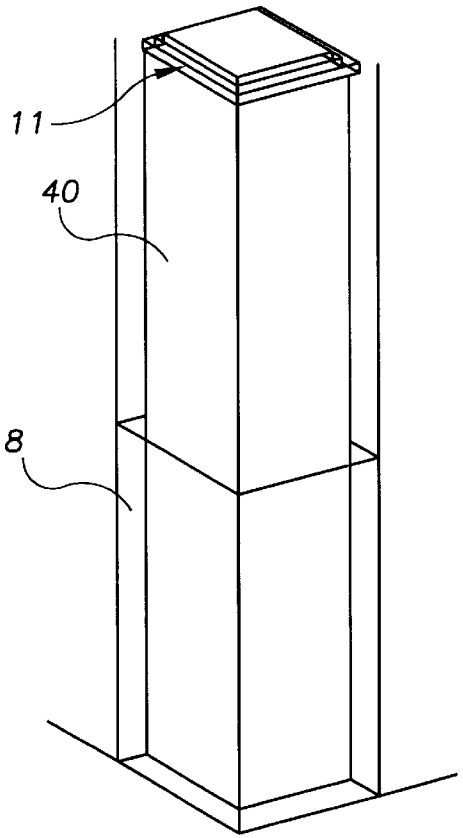
FIG. 9 depicts a perspective view of the fourth embodiment.
Figure 10:
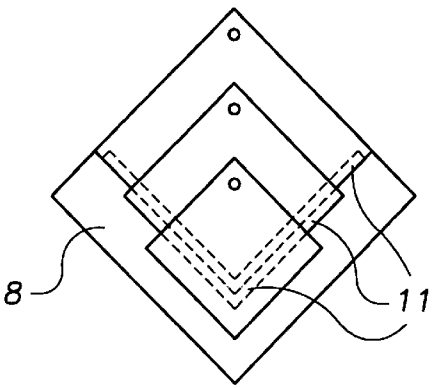
FIG. 10 depicts a partial top view of the fourth embodiment.
Figure 8:
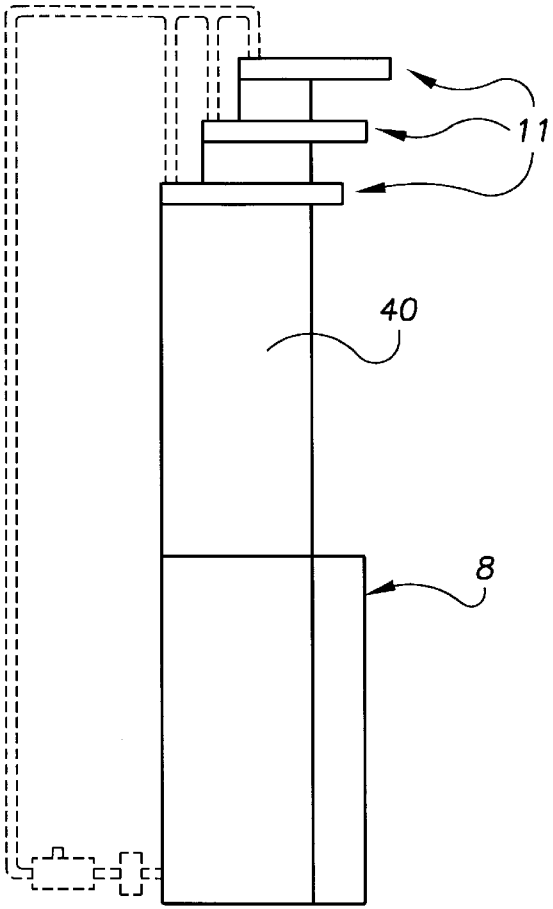
FIG. 8 depicts a side view of a fourth embodiment of the present invention designed to be installed within a wall corner.

FIGS. 8, 9 and 10 refer to a cascading water system according to the present invention designed to be built into an outer corner of a wall. The device includes multi-tiered display members supported by a vertical column 40 built into the corner of a wall. A reservoir surrounds a portion of the vertical column for receiving water from the tiered display members.

Figure 11:
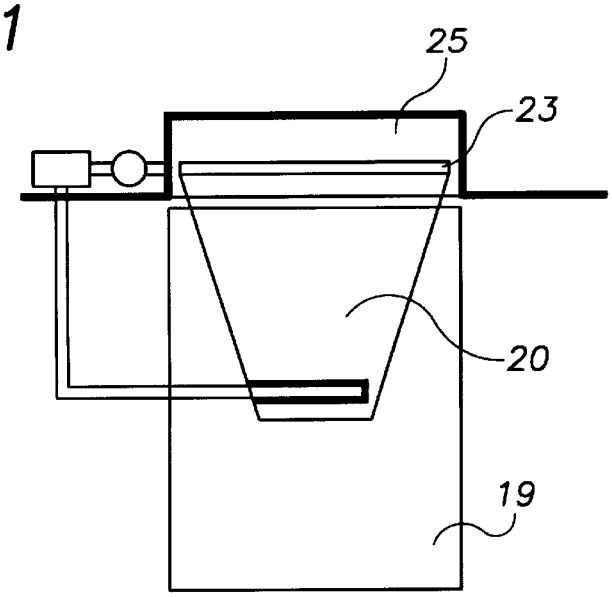
FIG. 11 depicts a top view of a fifth embodiment of the present invention.
Figure 12:
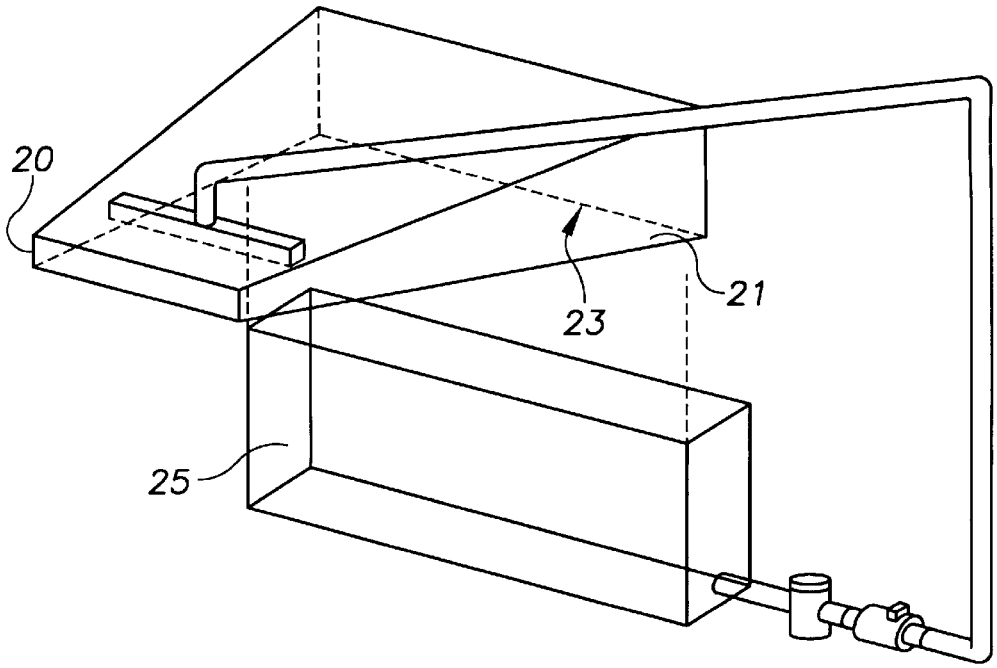
FIG. 12 depicts a perspective view of the fifth embodiment.

The device depicted in FIGS. 11 and 12 is designed to be built into a wall directly behind a bed 19. An upper display member 20 depends from the ceiling above the bed. The bottom surface 21 of the display member is sloped downwardly towards a rear end having an outlet 23 adjacent thereto through which the water falls into a vertically oriented reservoir 25 visibly mounted within the wall.

Figure 13:
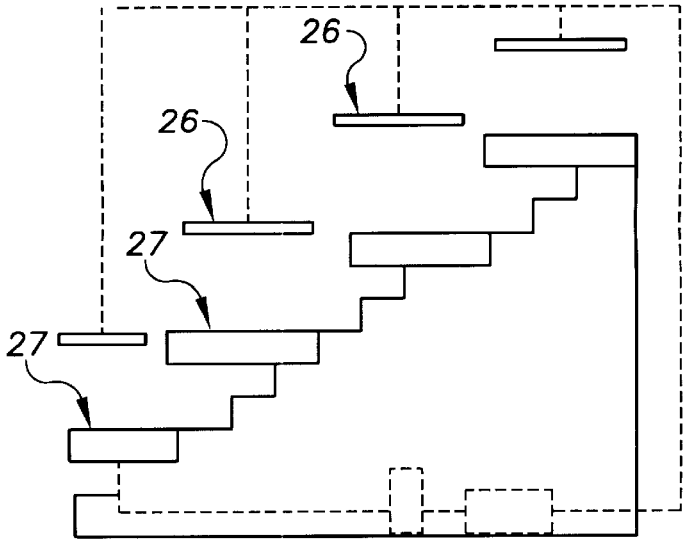
FIG. 13 depicts a front view of a sixth embodiment of the present invention designed to be mounted adjacent a stairwell.
Figure 14:
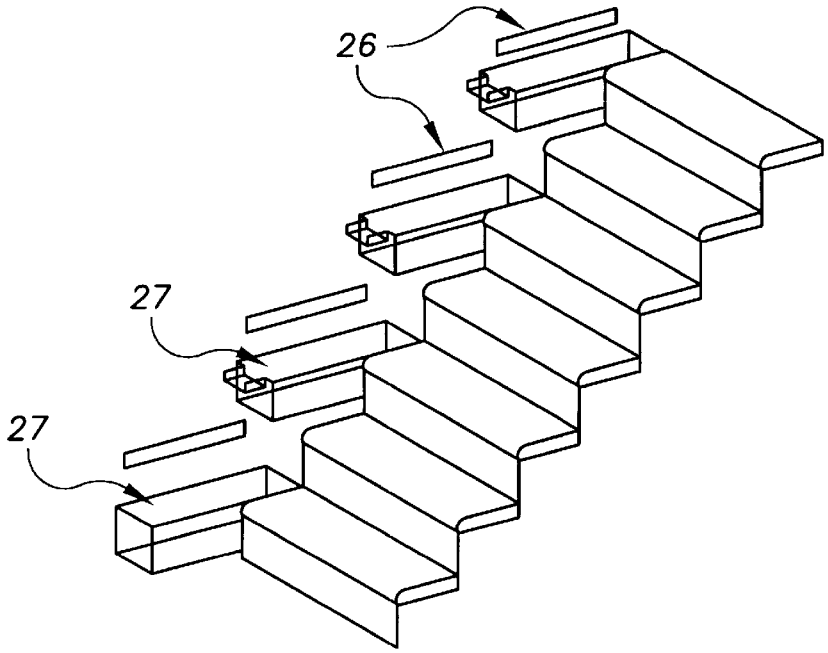
FIG. 14 depicts a perspective view of the sixth embodiment.

FIGS. 13 and 14 depict a cascading water system designed to be mounted adjacent a stairwell. A display member 26 is mounted adjacent each stair having an outlet opening disposed immediately above a designated reservoir 27. Each reservoir drains into the reservoir disposed immediately therebelow and ultimately to the lowermost reservoir where the water is recirculated back to the display members.

Figure 15:
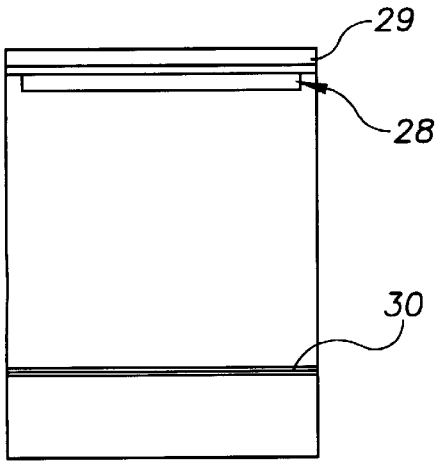
FIG. 15 depicts a partial front view of a seventh embodiment of the present invention designed to be built into an existing window frame.
Figure 16:
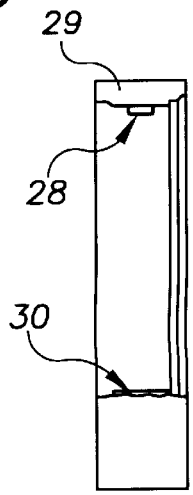
FIG. 16 depicts a partial side view of the seventh embodiment.
Figure 17:
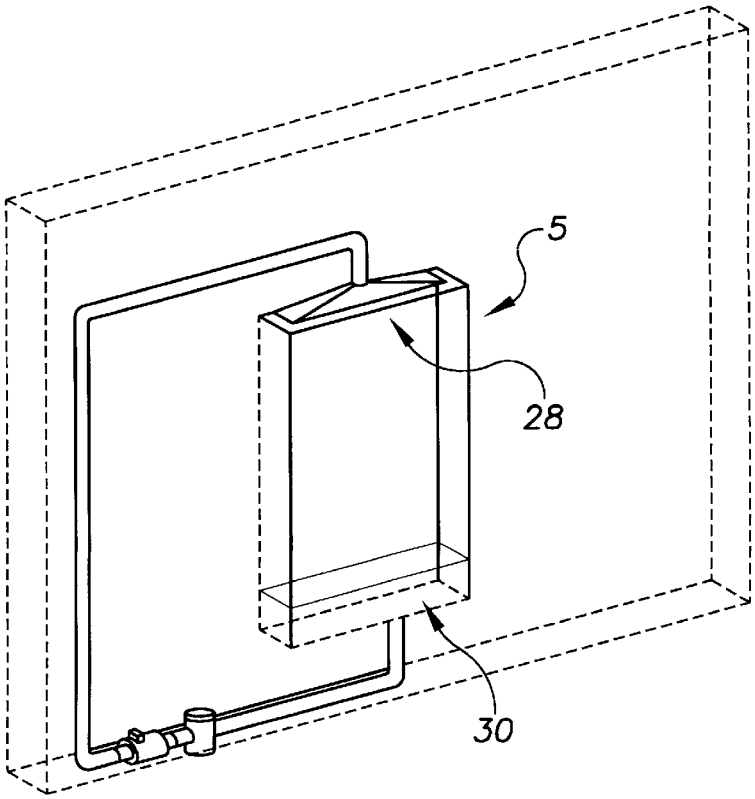
FIG. 17 depicts a perspective view of the seventh embodiment.

FIGS. 15, 16 and 17 depict a device specifically designed for mounting within a window opening. The embodiment includes a water dispersal header 28 mounted within the upper portion of the window frame 29 through which water cascades downwardly to a reservoir 30 built within the lower portion of the frame.

Figure 20:
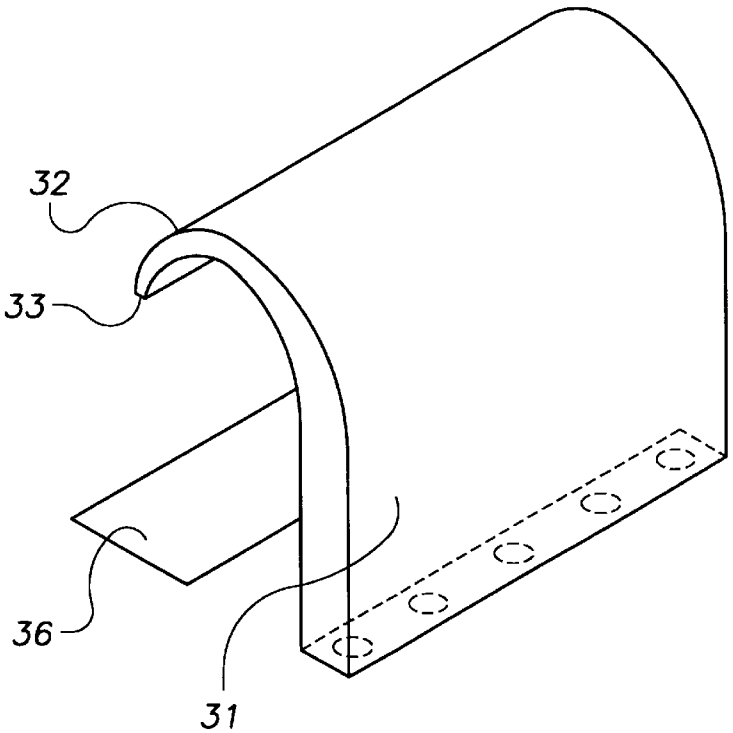
FIG. 20 depicts a perspective view of the eighth embodiment of the present invention.
Figure 18:
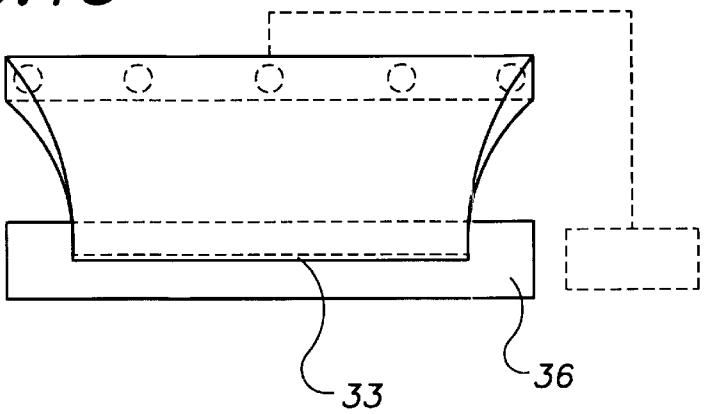
FIG. 18 depicts a top view of an eighth embodiment of the present invention having an arcuate water display member.
Figure 19:
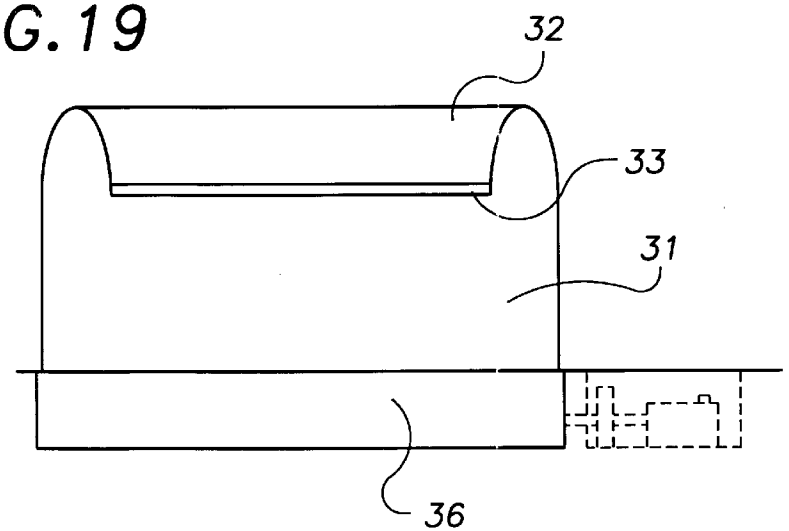
FIG. 19 depicts a front view of the eighth embodiment.

FIGS. 18, 19 and 20 depict devices primarily designed for outdoor use. The embodiment includes one or more display members having a vertically oriented portion 31 with an upper arcuate overhanging portion 32. The overhanging portion terminates at an outlet 33 through which water drains to a reservoir 36 mounted at ground level. The space between the reservoir and the base member defines a walkway allowing the user to walk behind a waterfall.

Figure 22:
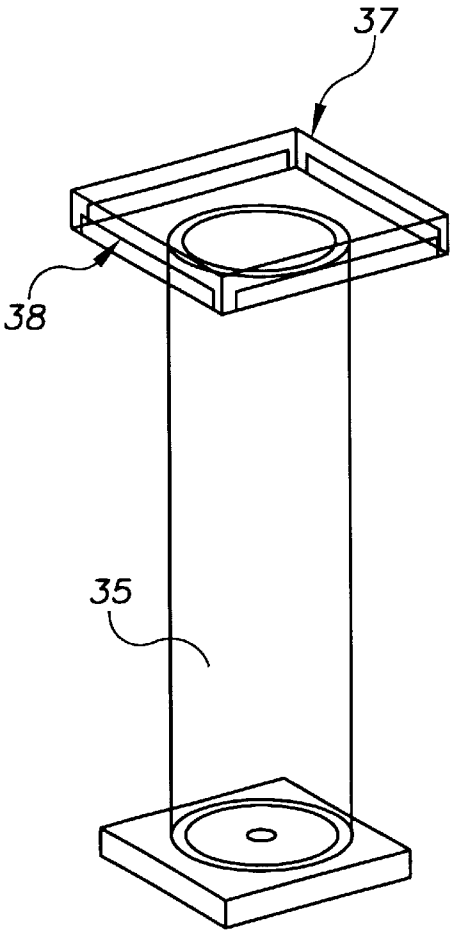
FIG. 22 depicts a perspective view of the ninth embodiment.
Figure 21:
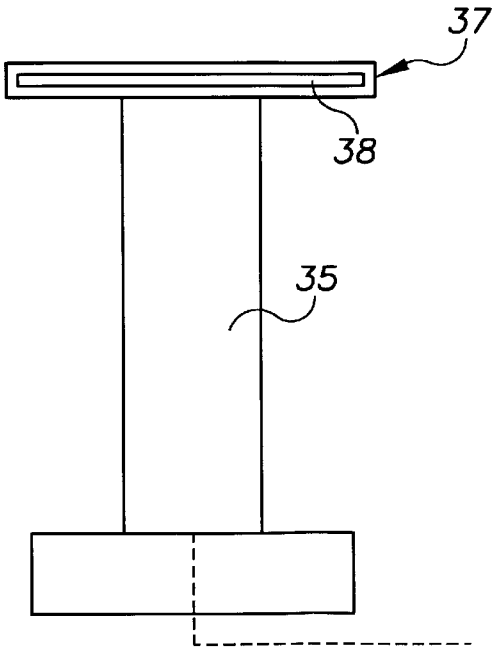
FIG. 21 depicts a side view of a ninth embodiment of the present invention designed to be mounted within a swimming pool.

FIGS. 21 and 22 depict a device mounted to the bottom of a swimming pool. A transparent horizontal column 35 includes a substantially rectangular dispersal member 37 having four sides each having an opening 38 thereon through which water exits and flows outwardly and downwardly to create four waterfalls.

The above described water display system is installed into a desired architectural structure such as a wall, doorway, ceiling, floor or similar location. The shape, size, configuration and materials of construction of the water display and dispersal members may be varied to suit a particular application or to achieve a desired aesthetic effect. The transparent display members and vertical columns are preferably constructed with plexiglass or a similar equivalent.

However, as will be readily apparent to those skilled in the art, the size, shape and materials of construction of the various components may varied without substantially departing from the spirit of the present invention. Therefore, the scope of the invention is only to be limited by the following claims.

What is claimed is:

1. In combination with an architectural structure selected from a group consisting of a ceiling, wall, and doorway, a water display system comprising:

at least one hollow transparent display member having a predetermined configuration with an inlet and an outlet, said display member integrated within said architectural structure so as to be at least partially visible to passersby;

a fluid reservoir having a fluid therein, said reservoir in fluid communication with the outlet of said display member;

a conduit extending from said reservoir to the inlet of said display member;

a pump for continuously circulating fluid between said reservoir and said display member.

2. The combination according to claim 1 further comprising a filter mounted within said conduit for removing particulate matter from said fluid.

3. The combination according to claim 2 further comprising a water jet mounted to said conduit at the inlet of said display member for evenly dispersing water within said display member.

4. The combination according to claim 3 wherein said display member is arcuate and integrated within an arched header of said doorway.

5. The combination according to claim 3 wherein said water system includes a plurality of said display members arranged in a tier like fashion.

6. The combination according to claim 3 wherein said display member is T-shaped and is integrated within said ceiling, said display member having four terminal portions, each having a fluid outlet adjacent thereto, said system further including a reservoir adapted to be mounted within each of four corners of a room, each of said reservoirs disposed immediately beneath a designated fluid outlet for receiving fluid from said display member.

* * * * *